US005393725A

United States Patent [19]

Abe et al.

[11] Patent Number: 5,393,725

[45] Date of Patent: * Feb. 28, 1995

[54] THERMAL TRANSFER SYSTEM, PRINTING PAPER AND INK RIBBON FOR THE THERMAL TRANSFER SYSTEM

[75] Inventors: Tetsuya Abe; Toshio Fukuda; Yoshio Fujiwara, all of Kanagawa, Japan

[73] Assignee: Sony Corporation, Japan

[ * ] Notice: The portion of the term of this patent subsequent to Jan. 11, 2011 has been disclaimed.

[21] Appl. No.: 980,542

[22] Filed: Nov. 23, 1992

[30] Foreign Application Priority Data

Nov. 28, 1991 [JP] Japan ..... 3-314276

[51] Int. Cl.[6] ..... B41M 5/035; B41M 5/38

[52] U.S. Cl. ..... 503/227; 428/195; 428/532; 428/536; 428/913; 428/914

[58] Field of Search ..... 8/471; 428/195, 532, 428/536, 913, 914; 503/227

[56] References Cited

U.S. PATENT DOCUMENTS 4,764,178 8/1988 Gregory et al. ..... 8/471

5,013,710 5/1991 Kanto et al. ..... 503/227

FOREIGN PATENT DOCUMENTS

0505993A1 9/1992 European Pat. Off. ..... B41M 5/00

60-180889 9/1985 Japan ..... 503/227

*Primary Examiner*—B. Hamilton Hess

*Attorney, Agent, or Firm*—Limbach & Limbach; Alan S. Hodes

[57] ABSTRACT

A thermal transfer system comprises, in combination, an ink ribbon which has an ink layer containing a dye and a printing sheet having an image-receiving layer. In the system, when the ink layer is heated in an imagewise pattern, the dye in the ink layer is melted or sublimated and transferred to the image-receiving layer in the imagewise pattern. The dye in the ink layer is selected from the group consisting of disazo dyes, isothiazole azo dyes and mixtures thereof and the image-receiving layer comprises a cellulose ester resin. The printed matter obtained has good light fastness and fading resistance in the dark comparable to silver salt photographs. The ink ribbon and the printing sheet are also provided, respectively.

31 Claims, No Drawings

THERMAL TRANSFER SYSTEM, PRINTING PAPER AND INK RIBBON FOR THE THERMAL TRANSFER SYSTEM

BACKGROUND OF THE INVENTION

1. Field of The Invention

This invention relates to a thermal transfer system which is, for example, adapted for use in color video printers. The invention also relates to a printing paper and an ink ribbon particularly Useful in the thermal transfer system.

2. Description of The Prior Art

Thermal transfer printing systems are known in the art in which images are obtained by heating an ink layer which contains a dye and is supported on a substrate, thereby melting and diffusing the dye in an imagewise pattern so that the dye is transferred on an image-receiving layer of a printing paper mainly composed of a resin. Intensive studies have been hitherto made on thermal transfer printing materials used in the system in order to improve the light fastness of the printing materials to an extent as close as that of silver salt photographs. For instance, attempts have been made to add UV absorbers and/or antioxidant agents to the image-receiving layer.

However, the UV absorber is not so effective unless the absorber is provided as an upper layer below which the dye is received. When the UV absorber is added to a laminated layer, its effect is lasting but with the disadvantage that a printing time is prolonged.

On the other hand, antioxidant agents may be effective for specific types of dyes. However, several types of dyes are used for yellow, magenta and cyan colors and existing antioxidant agents are not effective for all of these dyes. In an extreme case, antioxidant agents may expedite degradation of dyes. Further studies have been made on the structure of dyes and the type of resin used for the image-receiving layer, with an attendant problem that there has not been obtained yet any thermal transfer system comparable to silver salt photographs.

SUMMARY OF THE INVENTION

It is accordingly an object of the invention to provide a thermal transfer system which ensures improved light fastness and resistance to fading in the dark which are comparable to those of silver salt photographs.

It is another object of the invention to provide a printing paper sheet which is effective for use in the thermal transfer system.

It is a further object of the invention to provide an ink ribbon useful in such a thermal transfer system.

The thermal transfer system according to the invention which comprises, in combination, an ink ribbon which has an ink layer containing a dye and a printing sheet having an image-receiving layer wherein when the ink layer is heated in an imagewise pattern, the dye in the ink layer is melted or sublimated and transferred to the image-receiving layer in the imagewise pattern, the dye in the ink layer being selected from the group consisting of disazo dyes, isothiazole azo dyes and mixtures thereof, the image-receiving layer comprising a cellulose ester resin. Preferably, the image-receiving layer consists of a cellulose ester resin.

According to another embodiment of the invention, there is provided a printing sheet which is adapted for use in a thermal transfer system wherein an image is formed by heating an ink ribbon which has an ink layer containing a dye selected from the group consisting of disazo dyes, isothiazole azo dyes and mixtures thereof thereby melting or sublimating the dye in an imagewise pattern and transferring the dye to a printing sheet, the printing sheet comprising an image-receiving layer which comprises a cellulose ester resin as its main component.

According to a further embodiment of the invention, there is also provided an ink ribbon which is adapted for use in a thermal transfer system wherein an image is formed by heating an ink ribbon which has an ink layer containing a dye, thereby melting or sublimating the dye in an imagewise pattern and transferring the dye to an image-receiving layer of a printing sheet which comprises a cellulose ester as its main component, the dye in the ink layer being selected from the group consisting of disazo dyes, isothiazole azo dyes and mixtures thereof.

The images obtained according to the thermal transfer system including the printing sheet and the ink ribbon are comparable to silver photographs with respect to the light fastness and the resistance to fading in the dark.

DETAILED DESCRIPTION AND EMBODIMENTS OF THE INVENTION

The thermal transfer system according to the invention comprises an ink ribbon which has an ink layer containing a dye and a printing sheet having an image-receiving layer. The dye should be melted or sublimated on heating of the ink ribbon in an imagewise pattern. The melted or sublimated dye in the imagewise pattern is then transferred to the image-receiving layer thereby forming an image on the layer.

The ink ribbon should contain a dye in the ink layer and the dye is selected from disazo dyes, isothiazole azo dyes and mixtures thereof. Specific and preferable examples of the dye useful in the present invention are those which are particularly shown in examples appearing hereinafter. In Examples 1 to 8, there are shown disazo dyes and isothiazole azo dyes represented by the formulas.

For the formation of the ink layer, the dye is dispersed in a resin as is well known in the art. This is particularly described in the examples.

The printing sheet of the invention should have a support and an image-receiving layer formed on the support. The support may be made of materials ordinarily used for this purpose. The image-receiving layer of the printing sheet according to the invention is made mainly of a cellulose ester resin. Preferably, the layer consists of a cellulose ester resin.

The cellulose ester resins useful in the practice of the invention include those which are obtained by reaction between cellulose and organic acids. Commercially available cellulose ester resins include cellulose acetate butyrate (CAB), cellulose acetate propionate (CAP), cellulose acetate (CA) and the like. In view of the chemical structure, there may be further used aromatic esters of cellulose such as cellulose benzoate, cellulose toluate and the like, and aliphatic acid esters having 4 or more carbon atoms of cellulose such as cellulose caproate, cellulose laurate and the like.

The molecular weight of the cellulose ester is preferably from 10,000 to 70,000 for CAB, from 10,000 to 80,000 for CAP and from 30,000 to 60,000 for CA. The degree of esterification should preferably be within a range which allows the ester resin to be soluble in non-polar solvents such as benzene, toluene and the like. The degree of esterification of commercially available cellulose ester resins is as follows: the degree of acetylation is in the range of from 2 to 30% for CAB, from 0.5 to 30% for CAP, and about 40% for CA; and the degree of butyration is from 17 to 60% for CAB; and the degree of propionylation is about 50% for CAP.

Cellulose esters are commercially available from Eastman Kodak, for example, under designations of CAB551-a01, CAB551-0.2, CAB551-0.2, CAB531-1, CAB500-1, CAB-500-5, CAB-553-0.4, CAB-381-0.1, CAB-381-0., CAB-381-0.5BP, CAB-381-2, CAB-381-2BP, CAB-381-20, CAB381-20BP and CAB-171-15S for cellulose acetate butyrate, CAP482-0.5, CAP482-20 and CAP504-0.2 for cellulose acetate propionate, and CA-394-60S, CA-398-3, CA-398-6, CA-398-10 and CA-398-30 for cellulose acetate.

If desired, cellulose ester resins may be mixed with other types of resins such as polyesters, polyurethanes, polyamides and the like. These resins may be used in amounts of from 0.05 to 50 wt % based on the cellulose ester resin.

The image-receiving layer may be formed on a support by a usual manner in a thickness of from 0.5 to 30 micrometers.

The present invention is more particularly described by way of examples. Comparative examples are also shown.

First, the printing procedure is described.

Preparation of Ink Ribbon for Thermal Transfer Printing:

| | |
|---|---|
| Dyes (see examples appearing hereinafter) | 3.4 parts by weight |
| Butyral Resin (commercial name 6000EP, available from Denka Butyral Co., Ltd.) | 3.4 parts by weight |
| Methyl ethyl ketone | 49.3 parts by weight |
| Toluene | 47.4 parts by weight |

A mixture of the above formulation was agitated to prepare an ink. The ink was applied onto a 6 μm thick, back side-treated PET film by means of a coil bar in a dry thickness of 1 μm.

Preparation of a Printing Sheet for Thermal Transfer Printing:

An image-receiving layer composition was applied onto a 150 μm thick synthetic paper (commercial name of FPG-150, available from Ohji Yuka Co.,Ltd.) in a dry thickness of 10 μm and cured under conditions of 50° C. and 48 hours.

Image-receiving Layer Composition

| | |
|---|---|
| Cellulose ester resin (mixture of CAB551-0.01 and CAB500-5 in equal amounts) | 100 parts by weight |
| Compound for enhancing affinity for dye (dicyclohexyl phthalate, product of Osaka Organic Chem. Co., Ltd.) | 20.0 parts by wt. |
| Isocyanate (Takenate D 110N, product of Takeda Pharm. Co., Ltd.) | 5.0 parts by wt. |
| Modified silicone oil) SF8427, Toray-Dow Corning Co., Ltd.) | 3.0 parts by wt. |
| Fluorescent brightener Ubitex OB, Chiba-Geigy) | 0.2 parts by wt. |
| Methyl ethyl ketone | 247.0 parts by wt. |
| Toluene | 247.0 parts by wt. |

Transfer Printing:

The ink ribbons and the printing sheet were used for twelve gradation steer step printing by the use of Printer CVP-G500 of Sony Co., Ltd.

The print was evaluated by the following methods.

Light fastness test

The printing sheet on which the twelve gradation steer step printing had been made by the use of CVP-G500 was subjected to irradiation of 120,000 KJ/m$^2$ (1250 KJ/m$^2$·hr×96 hours) by use of a Xenon arc fadeometer (made by Suga Testing Machine Co., Ltd.) The densities prior to and after the irradiation were measured by means of the Macbeth densitometer (TR-924) at a maximum density portion and at a gradation portion with a density of about 1.0. The residual rate of the dye was calculated according to the following equation.

$$\text{Residual rate of dye (\%)} = \frac{\text{(density after the irradiation with the Xenon arc)}}{\text{(density prior to the irradiation with the Xenon arc)}} \times 100$$

Fading-in-the-dark test

The printing sheet on which the twelve gradation steer step print had been made by the use of CVP-G500 was allowed to stand in a thermo-hygrostat vessel under conditions of 60° C. and 85 R.H.% for 14 days thereby effective a preservation test. The densities prior to and after the test were measured by the use of the Macbeth densitometer (TR-924) at a maximum density portion and at a gradation portion with a density of about 1.0. The residual rate of the dye was calculated according to the following equation.

$$\text{Residual rate of dye (\%)} = \frac{\text{(density after the fading test in the dark)}}{\text{(density prior to the fading test in the dark)}} \times 100$$

The light fastness test and the fading test in the dark were carried out using different types of dyes which were contained in the ink layer of the ink ribbon. There are shown dyes used in the following examples 1 to 8 and comparative examples 1 to 3.

EXAMPLE 1

Disazo dye of the following formula:

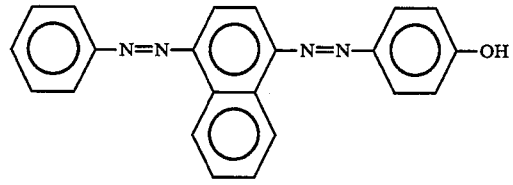

EXAMPLE 2

Disazo dye of the following formula (C.I. Disperse Yellow 23):

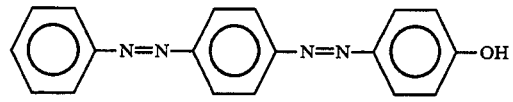

EXAMPLE 3

Disazo dye of the following formula (C.I. Disperse Yellow 7)

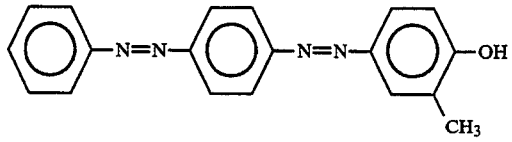

EXAMPLE 4

Disazo dye of the following formula (C.I. Disperse Orange 29)

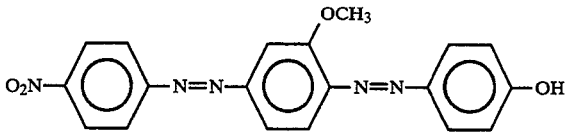

EXAMPLE 5

Isothiazole azo of the following formula (set out in Japanese Patent Publication No. 45-11024)

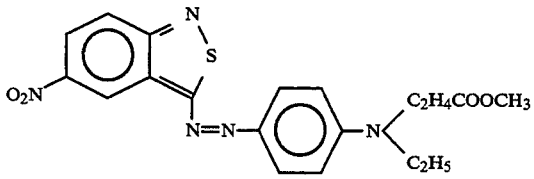

EXAMPLE 6

Isothiazole azo of the following formula (set out in Japanese Laid-open Patent Application No. 56-55455)

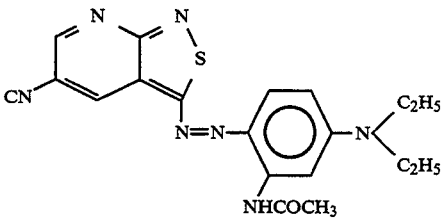

EXAMPLE 7

Isothiazole azo of the following formula (set out in Japanese Laid-open Patent Application No. 52-87420)

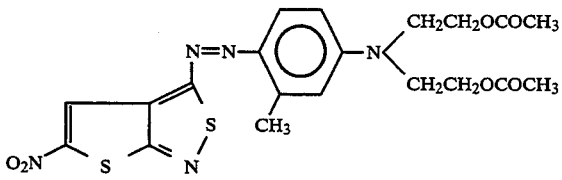

EXAMPLE 8

Mixture of the dyes of Examples 1 and 5 at a mixing ratio by weight of 4:6.

Comparative Example 1

Styryl dye of the following formula (ESC Yellow 155, made by Sumitomo Chem. Co., Ltd.)

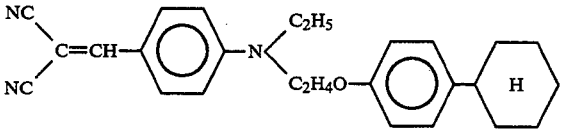

Comparative Example 2

Styryl dye of the following formula (Foron Blue, made by Sandz Co., Ltd.)

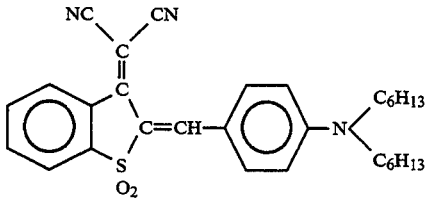

Comparative Example 3

Anthraquinone dye of the following formula (ESC Blue 655, made by Sumitomo Chem. Co., Ltd.)

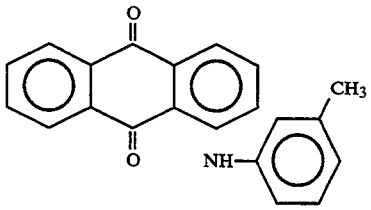

In comparative examples 4 to 6, the respective colors were developed in a steer step manner.

Comparative Example 4

Yellow color print photograph of Fuji Photo. Co., Ltd.

Comparative Example 5

Magenta color print photograph of Fuji Photo. Co., Ltd.

Comparative Example 6

Cyan color print photograph of Fuji Photo. Co., Ltd.

Comparative Example 7

A print was made on a commercially sold printing sheet, VPM-30ST, of Sony Co., Ltd., by the use of the ink ribbon of

EXAMPLE 8

The printed matters obtained in Examples 1 to 8 and Comparative Examples 1 to 7 were subjected to the light fastness test and also to the fading test in the dark under conditions set forth before. The results are shown in the following table.

Results of The Light Fastness Test and fading Test In The Dark

| | Light Fastness Test | | Fading Test In The Dark | |
|---|---|---|---|---|
| | maximum density portion | portion with a density of about 1.0 | maximum density portion | portion with a density of about 1.0 |
| Example 1 | 98.6 (%) | 95.2 (%) | 100.0 (%) | 100.0 (%) |
| Example 2 | 98.5 | 95.0 | 100.0 | 99.0 |
| Example 3 | 98.3 | 95.1 | 100.0 | 98.0 |
| Example 4 | 98.0 | 94.5 | 99.2 | 97.5 |
| Example 5 | 97.1 | 88.8 | 100.0 | 99.0 |
| Example 6 | 96.5 | 86.5 | 99.4 | 96.2 |
| Example 7 | 98.0 | 90.0 | 99.5 | 98.0 |
| Example 8 | 100.0 | 93.5 | 100.0 | 100.0 |
| Comp. Ex. 1 | 82.3 | 69.2 | 97.8 | 99.1 |
| Comp. Ex. 2 | 57.6 | 46.5 | 65.9 | 67.0 |
| Comp. Ex. 3 | 55.3 | 47.6 | 66.5 | 67.4 |
| Comp. Ex. 4 | 97.0 | 94.8 | 98.0 | 96.5 |
| Comp. Ex. 5 | 97.8 | 95.9 | 91.5 | 98.1 |
| Comp. Ex. 6 | 92.8 | 89.1 | 96.4 | 85.5 |
| Comp. Ex. 7 | 31.3 | 10.1 | 95.0 | 92.0 |

From the results of the light fastness test (density of about 1.0), it will be seen that while with the dyes having such structures other than those of the invention, the residual rate is in the range of about 47% to 70% as shown in Comparative Examples 1 to 3, all the dyes used in Examples 1 to 7 ensure a residual rate of not less than 85% and exhibit excellent light fastness characteristics. In addition, the printed matters of the examples of the invention are equal to or better than the silver salt photographs of Comparative Example 4–6 for purposes of the fading Thus, it will be appreciated that the thermal transfer system using the printing paper and the ink ribbon according to the invention have light fastness and fading resistance in the dark comparable to silver salt photographs.

What is claimed is:

1. A printing sheet which is adapted for use in a thermal transfer system wherein an image is formed by heating an ink ribbon which has an ink layer containing a dye selected from the group consisting of disazo dyes, isothiazole azo dyes and mixtures thereof thereby melting or sublimating the dye in an imagewise pattern and transferring the dye to a printing sheet, said printing sheet comprising an image-receiving layer which comprises a cellulose ester resin selected from the group consisting of cellulose acetate propionate and cellulose acetate butyrate as its main component.

2. The printing sheet according to claim 1, wherein said image-receiving layer consists of said cellulose ester resin.

3. The printing sheet according to claim 1, wherein said cellulose acetate propionate has a degree of acetylation of from 0.5 to 3% and a degree of propionylation of about 50%.

4. The printing sheet according to claim 1, wherein said cellulose acetate propionate has a molecular weight of from 10,000 to 80,000.

5. The printing sheet according to claim 1, wherein said cellulose acetate butyrate has a degree of acetylation of from 2 to 30% and a degree of butyration of from 17 to 60%.

6. The printing sheet according to claim 1, wherein said cellulose acetate butyrate has a molecular weight of from 10,000 to 70,000.

7. The printing sheet according to claim 1, wherein said cellulose ester resin is obtained from cellulose and a member selected from the group consisting of an aromatic carboxylic acid and an aliphatic carboxylic acid having not less than 4 carbon atoms.

8. A thermal transfer system comprising an ink ribbon having an ink layer containing a dye, said dye being selected from the group consisting of disazo dyes, isothiazole azo dyes and mixtures thereof, and a printing sheet having an image receiving layer comprising a cellulose ester resin.

9. The thermal transfer system according to claim 8, wherein said image-receiving layer consists of a cellulose ester resin.

10. The thermal transfer system according to claim 9, wherein said cellulose ester resin is cellulose acetate.

11. The thermal transfer system according to claim 10, wherein said cellulose acetate has a degree of acetylation of about 40%.

12. The thermal transfer system according to claim 10, wherein said cellulose acetate has a molecular weight of from 30,000 to 60,000.

13. The thermal transfer system according to claim 10, wherein said cellulose ester resin is cellulose acetate butyrate.

14. The thermal transfer system according to claim 13, wherein said cellulose acetate butyrate has a degree of acetylation of from 2 to 30% and a degree of butyration of from 17 to 60%.

15. The thermal system according to claim 13, wherein said cellulose acetate butyrate has a molecular weight of from 10,000 to 70,000.

16. The thermal transfer system according to claim 9, wherein said cellulose ester resin is cellulose acetate propionate.

17. The thermal transfer system according to claim 16, wherein said cellulose acetate propionate has a degree of acetylation of from 0.5 to 3% and a degree of propionylation of about 50%.

18. The thermal transfer system according to claim 16, wherein said cellulose acetate propionate has a molecular weight of from 10,000 to 80,000.

19. The thermal transfer system according to claim 8, wherein said cellulose ester resin is obtained from cellulose and a member selected from the group consisting of an aromatic carboxylic acid and an aliphatic carboxylic acid having not less than 4 carbon atoms.

20. The thermal transfer system according to claim 8, wherein said image-receiving layer comprises up to 50 wt % of the cellulose ester resin.

21. The thermal transfer system according to claim 8, wherein said dye is a disazo dye.

22. The thermal transfer, system according to claim 21, wherein said disazo dye is of the following formula

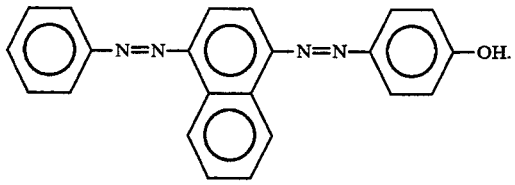

23. The thermal transfer system according to claim 21, wherein said disazo dye is of the following formula

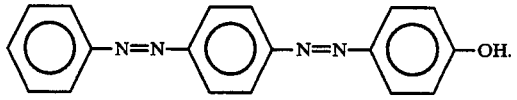

24. The thermal transfer system according to claim 21, wherein said disazo dye is of the following formula

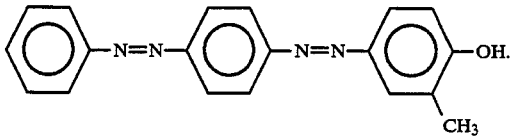

25. The thermal transfer system according to claim 21, wherein said disazo dye is of the following formula

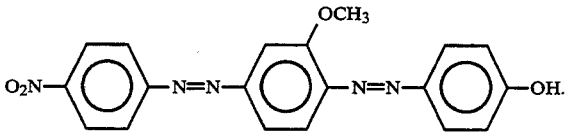

26. The thermal transfer system according to claim 8, wherein said dye is an isothiazole azo dye of the following formula

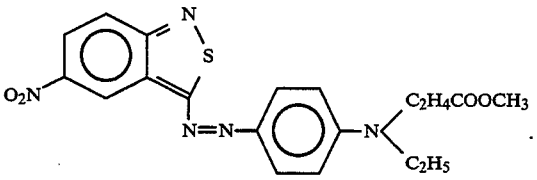

27. The thermal transfer system according to claim 8, wherein said isothiazole azo dye is of the following formula

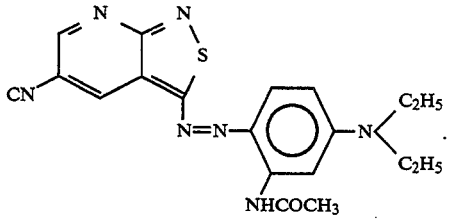

28. The thermal transfer system according to claim 8, wherein said isothiazole azo dye is of the following formula

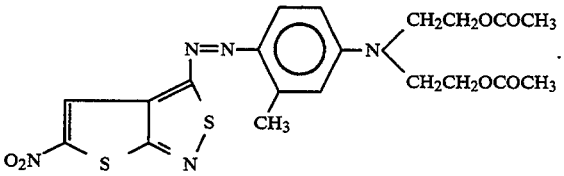

29. The thermal transfer system according to claim 8, wherein said dye is a mixture of a disazo dye and a isothiazole azo dye.

30. A thermal transfer printing method for transferring an image pattern from an ink ribbon to a printing sheet having an image receiving layer comprising the steps of:

(1) heating an ink layer on said ink ribbon to form an image pattern, said ink including a dye selected from the group consisting of disazo dyes, isothiazole azo dyes and mixtures thereof; and (2) transferring said dye to said image receiving layer, said image receiving layer comprising a cellulose ester resin.

31. A thermal transfer printing method according to claim 30 wherein said image receiving layer consists of a cellulose ester resin.

* * * * *